United States Patent [19]

Fritzemeier

[11] Patent Number: 4,787,633

[45] Date of Patent: Nov. 29, 1988

[54] METHOD OF PLAYING A BOWLING GAME

[75] Inventor: William H. Fritzemeier, Muskegon, Mich.

[73] Assignee: Brunswick Corporation, Muskegon, Mich.

[21] Appl. No.: 118,246

[22] Filed: Nov. 9, 1987

[51] Int. Cl.[4] ..... A63D 5/00

[52] U.S. Cl. ..... 273/37; 273/54 C

[58] Field of Search ..... 273/37, 54 C, 54 R, 273/54 D

[56] References Cited

U.S. PATENT DOCUMENTS

| | | | |
|---|---|---|---|
| 3,153,538 | 10/1964 | Rogers | 273/43 D |
| 3,212,780 | 10/1965 | Jewell | 273/54 C |
| 3,529,824 | 9/1970 | Walch | 273/54 R |
| 4,597,575 | 7/1986 | Kosof | 273/37 |

FOREIGN PATENT DOCUMENTS

| | | | |
|---|---|---|---|
| 809541 | 4/1969 | Canada | 273/54 C |

*Primary Examiner*—Anton O. Oechsle

*Attorney, Agent, or Firm*—Wood, Dalton, Phillips, Mason & Rowe

[57] ABSTRACT

A method of playing a bowling game in which players are allowed a preselected number of balls to knock down all pins in at least one pin setup. At least one pin setup of five pins is selected. Each player is allotted a given number of betting points. Each player is required to bet at least some of his betting points on his chances in the pin setup. Each player is required to deliver at least one ball in the pin setup. The number of pins delivered by each player is counted in the pin setup in order to knock down all the pins. A score is recorded for each player in each pin setup, the score being related to the respective player's bet. The players' scores are compared to determine the winner of the game.

24 Claims, 1 Drawing Sheet

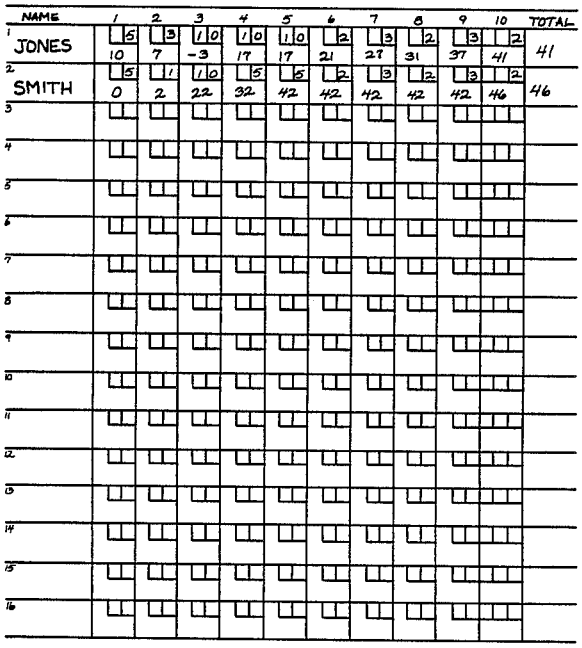

| NAME | 1 | 2 | 3 | 4 | 5 | 6 | 7 | 8 | 9 | 10 | TOTAL |
|---|---|---|---|---|---|---|---|---|---|---|---|
| 1 JONES | 5 / 10 | 3 / 7 | 10 / -3 | 10 / 17 | 10 / 17 | 2 / 21 | 3 / 27 | 2 / 31 | 3 / 37 | 2 / 41 | 41 |
| 2 SMITH | 5 / 0 | 1 / 2 | 10 / 22 | 5 / 32 | 5 / 42 | 2 / 42 | 3 / 42 | 2 / 42 | 3 / 42 | 2 / 46 | 46 |
| 3 | | | | | | | | | | | |
| 4 | | | | | | | | | | | |
| 5 | | | | | | | | | | | |
| 6 | | | | | | | | | | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |

| NAME | 1 | 2 | 3 | 4 | 5 | 6 | 7 | 8 | 9 | 10 | TOTAL |
|---|---|---|---|---|---|---|---|---|---|---|---|
| 1 JONES | 5<br>10 | 3<br>7 | 10<br>-3 | 10<br>17 | 10<br>17 | 2<br>21 | 3<br>27 | 2<br>31 | 3<br>37 | 2<br>41 | 41 |
| 2 SMITH | 5<br>0 | 1<br>2 | 10<br>22 | 5<br>32 | 5<br>42 | 2<br>42 | 3<br>42 | 2<br>42 | 3<br>42 | 2<br>46 | 46 |
| 3 | | | | | | | | | | | |
| 4 | | | | | | | | | | | |
| 5 | | | | | | | | | | | |
| 6 | | | | | | | | | | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |

METHOD OF PLAYING A BOWLING GAME

FIELD OF THE INVENTION

This invention generally relates to the sport of bowling and, particularly, to a method of playing a bowling game.

BACKGROUND OF THE INVENTION

Conventional bowling games are played by a method which depends on the order in which spares and strikes are scored by the players in turn. For many recreational or ordinary players, it is difficult to learn and understand the play of the game. This is because, in part, conventional bowling games require a strike or a spare to add a pin count for pins knocked down in subsequent frames to the pin counts in earlier frames. Quite often, running scores near the end of a game are not entered until the very last ball of a player is delivered. This cumbersome and difficult method of playing a conventional bowling game often leads to frustration and lack of interest to everyone but the skilled player. It is not uncommon for players to simply roll balls at pins and leave the scoring to others and never completely understand the rules of play. This leads to a lack of real interest and ultimately to players giving up on the sport.

In addition, conventional methods of playing bowling games often do not give a true indication of a player's skill. Leads shift back and forth during a game depending solely on sequences of strikes and spares, particularly near the end of a game. One player can build up such an early lead, again depending on his play timing, that other players lose hope and interest, and the level of play is greatly diminished.

There is a defininte need for new methods of playing a bowling game which are easier to understand and learn and, accordingly, to play; for games which are more exciting during the entire play of the game; for games which are challenging but not difficult; and for games to increase and enhance the public interest in the sport. This invention is directed to satisfying these needs and to rectifying problems inherent in the conventional method of playing a bowling game. In addition, the method of playing a bowling game according to this invention incorporates an element of chance to enhance the interest of the players and, in fact, incorporates the novel concept of embodying the scheme of a poker card game into the mechanical method of playing the bowling game.

SUMMARY OF THE INVENTION

An object of the invention, therefore, is to provide a new method of playing a bowling game in which players are allowed a preselected number of balls to knock down all pins in at least one pin setup.

According to the invention, at least one pin setup of five pins is selected. Each player is allotted a given number of betting points. Each player is required to bet at least some of his betting points on his chances in that pin setup. Each player is required to deliver at least one ball in that pin setup. The number of balls delivered by each player in each pin setup, in order to knock down all the pins, is counted. A score for each player in each pin setup is recorded, with the score being related to the respective player's bet. The players' scores are compared to determine the winner of the game.

In order to further enhance the play of the game and to stimulate interest during play, the five pins of the setup may be randomly selected, and each player ma be required to bet less than his given number of betting points on any given pin setup.

The invention contemplates correlating the number of balls delivered by each player in each pin setup with his respective bet. For instance, any player knocking down all pins in a given pin setup with one ball is given a score of a multiple of his bet, such as doubling his bet for an award of a comparable score. A player knocking down all pins in the given setup with two balls is given no score. A player failing to knock down all pins of the given pin setup with two balls is given a minus score of a multiple of his bet, such as subtracting a number of points equal to the bet made.

It can be seen that the above-described method of playing a bowling game somewhat simulates the aspects of a "stud" poker card game. To further enhance the play of the game, as in "draw poker", a player may be given the opportunity to choose up to three pins of the given pin setup to be eliminated and be replaced by an equal number of pins before delivering his first ball. This type of play is quite interesting when using automatic, computerized pin spotting equipment. In other words, if a player is randomly "dealt" a five-pin setup to his disliking, he can ask the computerized equipment to spot a different pin setup of up to three of the original pins being replaced by a random selection of three other pins. Thereafter, the play of the game continues as above described in relation to the scheme of "stud" poker, and a player may or may not be allowed to change his bet.

In order to better simulate a poker card game, all players in any given frame or turn may not have the same pin setup in that frame. In other words, there are no two aces-of-spades in a deck of cards, i.e. no two poker players can have the same hand. Players also could start out with a "kitty" score that goes up and down during play. If a player loses all his kitty point, he would go "bust" and lose. This kitty score would be shown on the score sheet or the alley screen.

Other objects and features of the invention will be apparent from the following detailed description taken in connection with the accompanying drawing.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawing showing a simulated score sheet which might be used in playing the bowling game of this invention.

DETAILED DESCRIPTION OF THE PREFERRED EMBODIMENT

The method of playing a bowling game according to the invention is designed to enhance the play of the game by incorporating an element of betting, chance and the like as might be incorporated in a card game, such as "stud" or "draw" poker. Of course, the method is not limited to such specific schemes.

Generally, players are allowed a preselected number of balls to knock down all pins in at least one pin setup. The pin setup may be of any number of pins, but to simulate a poker game, it may be desirable to select a five-pin setup. This selection can be predetermined or can be random as might be determined by a computerized bowling facility. In addition to the predetermined or random selection of the pin setup, each player is allotted a given number of points which he can bet during the play of the game. These points are used in conjunction with the player's success during a given pin setup or frame to determine a score. During play, each player is required to bet at least some of his betting points on his chances of success for a particular pin setup. The player may be required to bet less than a predetermined given number of betting points assigned at the beginning of play.

During play, for each frame, the number of balls delivered by each player in each pin setup in order to knock down all pins is counted. A score for each player in each pin setup is recorded, with the score being related to the respective player's bet. The players' scores are compared at the end of a plurality of frames or pin setups to determine the winner of the game.

Any player knocking down all pins in a given pin setup with only one ball can be given a score of a multiple of his bet for that frame, such as doubling his bet to arrive at a frame score. A player knocking down all pins in a given pin setup with two balls can be given no score. A player failing to knock down all pins in a given pin setup with two balls is given a minus score of a multiple of his bet, such as subtracting a score equal to the amount of the bet. Furthermore, the play may require a player to be given a preselected number of balls in which to knock down all pins in a given pin setup. After betting, the player who fails to knock down all of the pins with the given number of balls may simply be given no score.

Referring to the drawing in which a score sheet for a conventional bowling game is illustrated, assume that a twosome of "Jones" and "Smith" are playing the game. One or more frames or pin setups may be incorporated in the game, such as the pin frame columns illustrated on the score sheet. The number of pins in each frame and the manner of selecting the pins may be varied. However, a most interesting game according to the invention would be to have five pins in each frame (i.e. a five card poker hand) and to have the pins setup of those five pins to be randomly selected This can be done manually as using a card index, or a computer could be used to randomly select the different pin setups for each frame. In either instance, the same pin setup theoretically could be repeated.

Before beginning play, each player also is allotted a given number of betting points, such as 50 points which the player can use during play of the game. Such a limit would be desirable in the event that one of the players, by chance, is "dealt" a very easy pin setup. The player might bet an exhorbitant amount of points and, for all practical purposes, reduce the interest of the players during remaining, equally important frames.

Assuming that all of the pin frame pin setups are selected and the players are allotted their given number of betting points, play begins with frame "1" and each player, such as Jones, observes the pin setup and "places" his bet. It can be seen that both Jones and Smith bet five points on the pin setup of frame "1", and those bets are recorded in one of the small boxes on the score sheet in the column for frame "1", as shown. Jones delivers one ball and knocks down all five pins with the single ball. Since he bet five points, his score is doubled and he receives a score of "10" for that frame or pin setup. Smith takes his turn and requires two balls to knock down all of the pins in frame "1" and, therefore, is given a score of "0". Of course, other multiples of the betting points could be used. For instance, Jones might be awarded only his number of betting points, i.e. "5", should he knock down all pins with his one ball.

In the second or frame "2", a more difficult pin setup is encountered and, accordingly, Jones bets only three points and Smith bets only one point. Jones delivers two balls and still fails to knock down all the pins in that pin setup. Consequently, his betting points of "3" are subtracted from his running score of "10", resulting in a score of "7" after two frames or "hands". On the other hand, Smith was very fortunate in knocking down all the pins in frame "2" with his first ball whereupon Smith is entitled to a score of double his bet. Unfortunately, Smith only bet one point on the more difficult pin setup and, consequently, is awarded a score in the second frame of only "2". It immediately can be seen how the elements of chance and betting enter into the play of the game as determined by the success the players have in knocking down the pins in the respective pin setups or frames. A myriad of occurrences can be imagined.

For instance, assume frame "3" appears to be a very easy pin setup. Immediately, Jones and Smith both bet ten points on that pin setup with the expectation of achieving a high score. It turns out that Jones delivers two balls and still has pins remaining in frame "3". Consequently, Jones is given a minus score based on his bet, such as a minus "10", resulting in a running score of minus "3". Smith easily knocks down all of the pins in the third frame, doubling his bet, resulting in an addition of twenty points to his score. The score after three frames or "hands" now is "22" to "−3" in favor of Smith.

Without going into detail of each successive frame of the ten-frame game illustrated, a scenario has been shown in which Jones, being considerably behind after three frames, attempts to catch up by betting an exhorbitant number of points in the fourth and fifth frames. In the fourth frame, Jones knocked all pins down with a single ball, receiving twenty points and resulting in a running score of "17". In the fifth frame, Jones knocked down all pins with two balls, resulting in no points being given and a running score of "17" after the fifth frame. Smith, on the other hand, bet only five points in each of the fourth and fifth frames, knocking down all pins in each frame on his first ball, resulting in doubling his score or ten points for each frame. Smith thereby has taken a commanding lead, but Jones' problem now is that he bet too many points of his allotted 50 points and has only 12 betting points for use during the last five frames. Even though Jones knocked down all pins with his first ball in each of the last five frames, doubling his betting points in each frame, Jones still could only achieve a total of 41 points for the entire game, versus Smith's 42 points after five frames, because Jones gambled too much earlier in the game. Smith simply kept matching Jones' bets throughout the last five frames, knocking down all pins on the first ball in only the last frame, and still winning the game "46" to "41".

The above method of playing the bowling game can be modified by incorporating an element of "draw" poker into the play. With this modification, each player is given the opportunity to choose up to three pins of any given pin setup to be eliminated and be replaced by an equal number of pins before delivering his first ball. Again, this can be done manually, or by calling up a replacement of three designated pins randomly from the computer. The player then would be given a further opportunity to place or change his bet within his allotted number of betting points In order to better simulate a poker card game, all players in any given frame or turn may not have the same pin setup in that frame. In other words, there are no two aces-of-spades in a deck of cards, i.e. no two poker players can have the same hand. Players also could start out with a "kitty" score that goes up and down during play. If a player loses all his kitty points, he would go "bust" and lose. This kitty score would be shown on the score sheet or the alley screen.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of playing a bowling game in which players are allowed a preselected number of balls to knock down all pins in at least one pin setup, said method comprising:

(a) selecting at least one pin setup of five pins;
(b) allotting each player a given number of betting points;
(c) requiring each player to bet at least some of his betting points on his chances in said pin setup;
(d) requiring each player to deliver at least one ball in said pin setup;
(e) counting the number of balls delivered by each player in said pin setup in order to knock down all the pins;
(f) recording a score for each player in each pin setup, the score being related to the respective player's bet; and
(g) comparing the players' scores to determine the winner of the game.

2. The method of claim 1 wherein said five pins of said pin setup ar randomly selected.

3. The method of claim 2 wherein a plurality of random pin setups of five pins are selected.

4. The method of claim 1 wherein each player is required to bet less than his given number of betting points on any given pin setup.

5. The method of claim 1 wherein any player knocking down all pins in said pin setup with one ball is given a score of a multiple of his bet.

6. The method of claim 1 wherein any player knocking down all pins in said pin setup with two balls is given no score.

7. The method of claim 6 wherein any player failing to knock down all pins in said pin setup with two balls is given a minus score of a multiple of his bet.

8. The method of claim 5 wherein any player knocking down all pins in said pin setup with a preselected given number of balls in excess of one is given no score.

9. The method of claim 8 wherein any player failing to knock down all pins in said pin setup with said given number of balls is given a minus score of a multiple of his bet.

10. The method of claim 1 wherein any player is given the opportunity to choose up to three pins of said one pin setup to be eliminated and be replaced by an equal number of pins before delivering his first ball.

11. The method of claim 10 wherein said replaced pins are randomly selected.

12. The method of claim 10 wherein any player is given the opportunity to change his bet after said pins are replaced.

13. The method of claim 12 wherein said replaced pins are randomly selected.

14. The method of claim 1 wherein a plurality of differing pin setups are selected in a random sequence.

15. The method of claim 1 wherein the pin setups are different for each player in each turn of play.

16. A method of playing a bowling game in which players are allowed a preselected number of balls to knock down all pins in a plurality of pin setup frames, said method comprising:

(a) randomly selecting a plurality of differing pin setups defining said frames;
(b) allotting each player a given number of betting points;
(c) requiring each player to bet at least some of his betting points, less than his given number of betting points, on his chance in each of said frames;
(d) requiring each player to deliver at least one ball in said pin setup;
(e) counting the number of balls delivered by each player in said pin setup in order to knock down all the pins;
(f) recording a score for each player in each frame, the score being a multiple of the respective player's bet if the player knocks down all pins in the respective frame; and
(g) comparing the players' scores to determine the winner of the game.

17. The method of claim 16 wherein any player knocking down all pins in said frame with a preselected given number of balls in excess of one is given no score.

18. The method of claim 17 wherein any player failing to knock down all pins in said frame with said given number of balls is given a minus score of a multiple of his bet.

19. The method of claim 16 wherein any player is given the opportunity to choose up to three pins of said one frame to be eliminated and be replaced by an equal number of pins before delivering his first ball.

20. The method of claim 19 wherein said replaced pins are randomly selected.

21. The method of claim 19 wherein any player is given the opportunity to change his bet after said pins are replaced.

22. The method of claim 16 wherein any player knocking down all pins in said frame with two balls is given no score.

23. The method of claim 16 wherein the pin setups are different for each player in each turn of play.

24. A method of playing a bowling game in which players are allowed a preselected number of balls to knock down all pins in at least one pin setup, said method comprising:

(a) selecting at least one pin setup;
(b) allotting each player a given number of betting points;
(c) requiring each player to bet at least some of his betting points on his chances in said pin setup;
(d) requiring each player to deliver at least one ball in said pin setup;
(e) counting the number of balls delivered by each player in said pin setup in order to knock down all the pins;
(f) recording a score for each player in each pin setup, the score being related to the respective player's bet; and
(g) comparing the players' scores to determine the winner of the game.

* * * * *